US009508284B2

(12) United States Patent
Lim et al.

(10) Patent No.: US 9,508,284 B2
(45) Date of Patent: Nov. 29, 2016

(54) METHOD OF DRIVING ORGANIC ELECTROLUMINESCENT DISPLAY DEVICE

(71) Applicant: SAMSUNG DISPLAY CO., LTD., Yongin, Gyeonggi-Do (KR)

(72) Inventors: Sang-Min Lim, Cheonan-si (KR); Jung Kook Park, Cheonan-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 80 days.

(21) Appl. No.: 14/482,119

(22) Filed: Sep. 10, 2014

(65) Prior Publication Data

US 2015/0161941 A1 Jun. 11, 2015

(30) Foreign Application Priority Data

Dec. 10, 2013 (KR) ..... 10-2013-0153340

(51) Int. Cl.
*G09G 3/32* (2016.01)

(52) U.S. Cl.
CPC .... *G09G 3/3208* (2013.01); *G09G 2300/0861* (2013.01); *G09G 2310/0262* (2013.01); *G09G 2320/064* (2013.01); *G09G 2320/0633* (2013.01); *G09G 2320/0646* (2013.01); *G09G 2320/0666* (2013.01); *G09G 2320/0673* (2013.01); *G09G 2360/16* (2013.01)

(58) Field of Classification Search
USPC ..... 345/690–691, 77, 102, 207
See application file for complete search history.

(56) References Cited

U.S. PATENT DOCUMENTS

2003/0197663 A1* 10/2003 Lee ..... G09G 3/3233 345/76
2005/0057546 A1* 3/2005 Shibutani ..... G09G 3/22 345/204
2009/0262114 A1* 10/2009 Park ..... H04N 9/69 345/440
2010/0149167 A1* 6/2010 Hasegawa ..... G09G 3/3225 345/213
2013/0076974 A1* 3/2013 Atkins ..... H04N 5/235 348/362
2013/0169693 A1 7/2013 Pyo
2015/0365580 A1* 12/2015 Kunkel ..... H04N 5/57 348/234

FOREIGN PATENT DOCUMENTS

KR 10-0645700 B1 11/2006
KR 10-2007-0058970 A 6/2007
KR 10-2008-0082279 A 9/2008
KR 10-2013-0055256 A 5/2013
KR 10-2013-0055257 A 5/2013
KR 10-2013-0099588 A 9/2013

* cited by examiner

*Primary Examiner* — Jason Olson
*Assistant Examiner* — Deeprose Subedi
(74) *Attorney, Agent, or Firm* — Lee & Morse, P.C.

(57) ABSTRACT

A method for controlling a display device includes adjusting the luminance value of input data by a first method when the luminance value is greater than or equal to a predetermined number of nits, and adjusting the luminance value by a second method when the luminance value is less than the predetermined number of nits. The first method reduces the luminance value by a first predetermined percentage. The second method adjusts the luminance value to a first value corresponding to a predetermined luminance value set for the predetermined number of nits, and then reduces the first value by a second predetermined percentage different from the first predetermined percentage. The predetermined number of nits may be 2 nits or another number of nits.

18 Claims, 10 Drawing Sheets

FIG. 7A

| Reference grayscale Shift | | | | | | | | | 255 | | | 203 | | | 151 | | | 87 | | |
|---|---|---|---|---|---|---|---|---|---|---|---|---|---|---|---|---|---|---|---|---|
| V255 | V203 | V151 | V87 | V51 | V35 | V23 | V11 | V3 | R | G | B | R | G | B | R | G | B | R | G | B |
| | | | | | | | | | | | | | | | | | | | | |
| 0 | 6 | 13 | 20 | 25 | 27 | 31 | 34 | 35 | -4 | 0 | -3 | -2 | 1 | -2 | -3 | 1 | -4 | -7 | 3 | -8 |
| 0 | 5 | 8 | 12 | 15 | 16 | 16 | 17 | 18 | -4 | 0 | -3 | -2 | 1 | -2 | -3 | 1 | -4 | -7 | 3 | -8 |
| 0 | 5 | 9 | 13 | 16 | 17 | 18 | 19 | 20 | -4 | 0 | -3 | -2 | 1 | -2 | -3 | 1 | -4 | -7 | 3 | -8 |
| 0 | 5 | 9 | 15 | 18 | 19 | 20 | 22 | 23 | -4 | 0 | -3 | -2 | 1 | -2 | -3 | 1 | -4 | -7 | 3 | -8 |
| 0 | 5 | 9 | 15 | 18 | 19 | 22 | 24 | 26 | -1 | 0 | -1 | -1 | 1 | -1 | -2 | 1 | -3 | -6 | 1 | -7 |

FIG. 7B

| Reference grayscale Shift | | | | | | | | | 51 | | | 35 | | | 23 | | | 11 | | |
|---|---|---|---|---|---|---|---|---|---|---|---|---|---|---|---|---|---|---|---|---|
| V255 | V203 | V151 | V87 | V51 | V35 | V23 | V11 | V3 | R | G | B | R | G | B | R | G | B | R | G | B |
| | | | | | | | | | | | | | | | | | | | | |
| 0 | 6 | 13 | 20 | 25 | 27 | 31 | 34 | 35 | -9 | 4 | -8 | -7 | 3 | -4 | -5 | 3 | -3 | -6 | 4 | -5 |
| 0 | 5 | 8 | 12 | 15 | 16 | 16 | 17 | 18 | -9 | 3 | -8 | -7 | 2 | -4 | -5 | 2 | -3 | -6 | 3 | -5 |
| 0 | 5 | 9 | 13 | 16 | 17 | 18 | 19 | 20 | -9 | 3 | -8 | -7 | 2 | -4 | -5 | 2 | -3 | -6 | 3 | -5 |
| 0 | 5 | 9 | 15 | 18 | 19 | 20 | 22 | 23 | -9 | 3 | -8 | -7 | 2 | -4 | -5 | 2 | -3 | -6 | 3 | -5 |
| 0 | 5 | 9 | 15 | 18 | 19 | 22 | 24 | 26 | -8 | 2 | -7 | -6 | 3 | -4 | -5 | 4 | -4 | -6 | 4 | -8 |

METHOD OF DRIVING ORGANIC ELECTROLUMINESCENT DISPLAY DEVICE

CROSS-REFERENCE TO RELATED APPLICATION

Korean Patent Application No. 10-2013-0153340, filed on Dec. 10, 2013, and entitled, "Method of Driving Organic Electroluminescent Display Device," is incorporated by reference herein in its entirety.

BACKGROUND

1. Field

One or more embodiments described herein relate to a method of driving a display device.

2. Description of the Related Art

Flat panel displays are lighter in weight and volume than cathode ray tubes, and therefore are preferred by a vast majority of consumers. Examples of flat panel displays include liquid crystal displays, field emission displays, plasma display panels, and organic light emitting displays.

Organic light emitting displays have pixels which emit light from organic light emitting diodes (OLEDs). The light is emitted based on a combination of electrons and holes in an active layer. The electrons and holes are injected from respective electrodes, and combine to form excitons that emit light when transitioning to a stable state.

Because organic light emitting displays do not require a separate light source (e.g., backlight), they are lighter in volume and weight than other types of flat panel displays. Their use in electronic products, therefore, has become prevalent. Examples of products which use organic light emitting displays range from small portable terminals to large televisions. Organic light emitting displays are suitable for these applications because of their high luminance and high-speed response.

However, organic light emitting displays are not without drawbacks. For example, these displays may be glaring (e.g., too bright) and thus uncomfortable to view, especially in low-light conditions.

SUMMARY

In accordance with one embodiment, a method of driving an organic electroluminescent display device includes determining a luminance value from input data; adjusting the luminance value by a first method when the luminance value is greater than or equal to a predetermined number of nits; adjusting the luminance value by a second method when the luminance value is less than the predetermined number of nits; and generating data to which the first or second method is applied, wherein the first method adjusts the luminance value by adjusting light emission time and the second method adjusts the luminance value based on a light emission time that corresponds to the predetermined number of nits and then decreases the luminance value by a percentage by limiting a current, and wherein the predetermined number of nits is 10 nits.

The first method may include supplying the luminance value to a timing controller; extracting a light emission time value corresponding to the luminance value from a first lookup table; and controlling a light emission control driver in response to the extracted light emission time value. The first lookup table may include light emission times that decrease from a first luminance value to a second luminance value less than the first luminance value.

The second method may include supplying luminance of the predetermined number of nits to a timing controller; extracting a light emission time value corresponding to the predetermined number of nits from a first lookup table; controlling a light emission control driver in response to the extracted light emission time value; and decreasing the luminance by the percentage by limiting a current. The first lookup table may include light emission times that decrease with decreasing luminance, and a smallest luminance in the first lookup table corresponds to the predetermined number of nits.

Decreasing the luminance by the percentage may include determining a luminance compensation value from the luminance determined from the input data; extracting a degree of automatic current limit corresponding to the compensation value from a third lookup table; and limiting the current in response to the extracted degree of the automatic current limit.

The method may include measuring a luminance difference and color coordinates for the generated data; extracting an offset value for the luminance difference and color coordinates; and applying the extracted offset value. The offset value is extracted from a second lookup table, and the second lookup table includes offset values of red and blue larger than an offset value of green. Applying of the extracted offset value may include adjusting a gamma voltage in response to the offset value, and supplying the adjusted gamma voltage to the gamma voltage applying unit.

In accordance with another embodiment, a method of driving an organic electroluminescent display device includes generating a luminance value from input data; adjusting the luminance value based on a first method when the luminance value is greater than or equal to 10 nits; and adjusting the luminance value based on a second method when the luminance value is less than 10 nits, wherein the first method adjusts a light emission time according to the luminance value and the second method adjusts the luminance value based on a light emission time corresponding to the luminance value of 10 nits and then decreases the luminance by a percentage by limiting a current.

The first method may include supplying the luminance value to a timing controller; extracting a light emission time value corresponding to the luminance value from a first lookup table; and controlling a light emission control driver in response to the extracted light emission time value. The first lookup table may include light emission times that decrease from a first luminance value to a second luminance value less than the first luminance value.

The second method may include supplying the luminance value of 10 nits to a timing controller; extracting a light emission time value corresponding to 10 nits from a first lookup table; controlling a light emission control driver in response to the extracted light emission time value; and decreasing the luminance value by limiting the current. Decreasing the luminance value may include decreasing ratio of the luminance value based on the following equation: (the luminance value of 10 nits−first generated luminance value)*10%.

Decreasing the luminance value may include determining a luminance compensation value from the luminance generated from the input data; extracting a degree of automatic current limit corresponding to the compensation value from a third lookup table; and limiting the current in response to the extracted degree of the automatic current limit.

The method may include measuring a luminance difference and color coordinates for the generated data; extracting an offset value for the luminance difference and the color coordinates; and applying the extracted offset value. The offset value may be extracted from a second lookup table, and the second lookup table may include offset values of red and blue larger than an offset value of green.

Applying of the extracted offset value may include adjusting a gamma voltage in response to the offset value, and supplying the adjusted gamma voltage to the gamma voltage applying unit.

In accordance with another embodiment, a method for controlling a display device includes adjusting a luminance value of input data by a first method when the luminance value is greater than or equal to a predetermined number of nits; and adjusting the luminance value by a second method when the luminance value is less than the predetermined number of nits, wherein the predetermined number of nits is 10 nits. The first method may reduce the luminance value by a first predetermined percentage. The second method may adjust the luminance value to a first value that corresponds to a predetermined luminance value set for the predetermined number of nits, and then may reduce the first value by a second predetermined percentage different from the first predetermined percentage.

BRIEF DESCRIPTION OF THE DRAWINGS

Features will become apparent to those of skill in the art by describing in detail exemplary embodiments with reference to the attached drawings in which:

FIGS. 7A and 7B illustrate examples of offset values; and

DETAILED DESCRIPTION OF THE EMBODIMENTS

Figure 1:
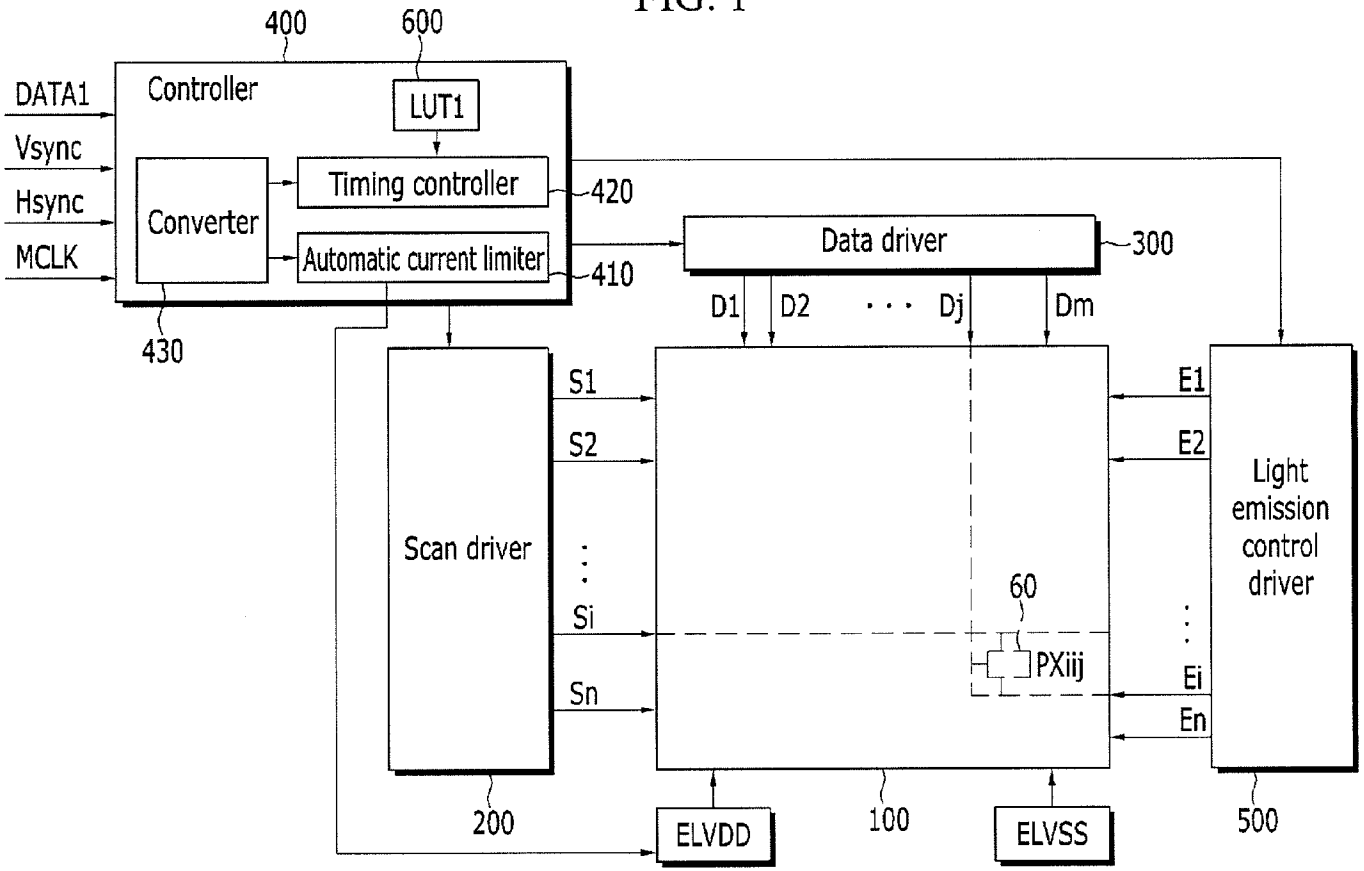
FIG. 1 illustrates an embodiment of an organic light emitting display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of an organic light emitting display. Referring to FIG. 1, the organic light emitting display includes a display unit 100 having a plurality of pixels, a scan driver 200, a data driver 300, a controller 400, and a light emission control driver 500.

The display unit 100 includes a plurality of pixels 60 connected to a plurality of signal lines. The pixels are may be arranged, for example, in the form of a matrix. The signal lines include a plurality of scan lines S1 to Sn transmitting scan signals, a plurality of data lines D1 to Dm transmitting data signals, and a plurality of emission control lines E1 to En transmitting emission control signals. The scan lines S1 to Sn and emission control lines E1 to En may extend in a row direction and may be parallel with each other. The data lines D1 to Dm extend in a column direction and may be parallel to one another.

For illustrative purposes, only one pixel circuit PXiij is illustrated in FIG. 1. This pixel circuit is connected to an ith scan line Si, a jth data line Dj, and an ith emission control line Ei. The remaining pixel circuits may have a structure similar to pixel PXiij.

Pixel circuit PXiij includes a light emitting device, for example, an organic light emitting diode (OLED). The light-emitting device is connected to a power supply unit supplying a first voltage ELVDD and power supply unit supplying a second voltage ELVSS. In one embodiment, the same power supply unit may supply the first and second voltages. The ends of the OLED are respectively connected to the first voltage ELVDD and second voltage ELVSS. In operation, the OLED emits light according to a current flowing between its terminals, e.g., a driving current Ioled.

Each pixel circuit generates driving current Ioled according to an image data signal, first voltage EVLDD, and second voltage ELVSS. The driving current Ioled is supplied to the OLED, and the OLED emits light at a luminance proportional to the driving current Ioled.

The scan driver 200 generates a plurality of scan signals and transmits the scan signals to respective ones of the scan lines S1 to Sn according to a scan driving control signal from controller 400. In one embodiment, scan driver 200 applies the scan signals to the display unit 100 for each specific period (for example, a horizontal synchronization signal (Hsync) period) under control of the scan driving control signal. The scan signals are signals for transmitting image data signals to the pixel circuits, by transmitting a signal activating respective pixels among the plurality of scan lines.

The data driver 300 receives a plurality of image data signals from the controller 400, and generates and transmits image data signals in the unit of one pixel row through respective ones of the D1 to Dm. In one embodiment, the scan driver 300 applies an image data signal to the display unit 100 for each specific period (for example, a vertical synchronization signal (Vsync) period) under control of the data driving control signal from the controller 400.

The controller 400 includes an automatic current limiter 410, a timing controller 420, a converter 430, a first lookup table 600. These features will be described in greater detail below.

The light emission control driver 500 generates a plurality of emission control signals, and transmits the emission control signals to respective ones of the emission control lines EM1 to Emn according to emission driving control signals from controller 400. In one embodiment, light emission control driver 500 applies an emission control signal to the display unit 100 for each specific period (e.g., a horizontal synchronization signal (Hsync) period) under control of the emission driving control signal.

The emission control signals control an emission duty cycle ratio of respective ones of the pixels. The emission duty cycle ratio may be controlled by the emission driving control signal, which may include information indicative of an off-duty width of a pulse calculated for adjusting luminance. In one embodiment, the emission driving control signal is formed by extracting a light emission time value for each luminance from first lookup table 600. The light emission control driver 500 is the controlled in accordance with the light emission time value by the timing controller 420.

That is, the light emission control driver 500 implements luminance through impulsive driving. Impulsive driving is a method for adjusting a driving on/off time for each of a plurality of luminance values. In one application of this method, black data may be inserted in applied data to adjust luminance.

The controller 400 receives an image data signal DATA1, a horizontal synchronization signal Hsync, a vertical synchronization signal Vsync, and a main clock signal MCLK from an external source. The controller 400 outputs an image data signal, which is converted in response to the scan driving control signal, data driving control signal, emission driving control signal, and image data signal DATA1. An image is then displayed on display unit 100 based on the image data signal DATA1.

As previously indicated, the controller 400 includes automatic current limiter 410, timing controller 420, and converter 430. The converter 430 generates a luminance value Y based on data Data. In one embodiment, converter 430 generates luminance value Y based on Equation 1.

$$Y=Kr\times R+Kg\times Kb\times B \quad (1)$$

In Equation 1, Kr, Kg, and Kb are constants and R, G, and B correspond to red data, green data, and blue data, respectively. Constants Kr, Kg, and Kb may be set to various values, for example, in accordance with a luminance contribution of the red, green, and blue data. In one non-limiting implementation, Kr is set to 0.2, Kg is set to 0.7, and Kb is set to 0.1.

Converter 430 extracts luminance value Y of at least one frame, and supplies the extracted luminance value Y to timing controller 420. For example, converter 430 may extract luminance value Y corresponding to data of one frame or two frames, and may supply the extracted luminance value Y to timing controller 420.

The timing controller 420 extracts a light emission time value from the first lookup table 600 in response to the luminance value Y. That is, the light emission time value corresponding to luminance value Y may be stored in advance in first lookup table 600. In one embodiment, the first lookup table 600 may be set so that light emission times decrease with decreasing luminance values.

In one example implementation, the light emission time value corresponding to the luminance value stored in the first lookup table may be represented by Table 1. In this table, light emission times are provided for low luminance values of 2 nits to 10 nits. Also, AOR in Table 1 means an AID off ratio. That is, AOR is a ratio of non-light emission time.

TABLE 1

| Luminance | 10 nit | 9 nit | 8 nit | 7 nit | 6 nit | 5 nit | 4 nit | 3 nit | 2 nit |
|---|---|---|---|---|---|---|---|---|---|
| AOR | 90.6% | 92.1% | 93.0% | 93.8% | 94.7% | 95.5% | 96.3% | 97.2% | 98% |

The timing controller 420 extracts the light emission time value from the first lookup table 600 and controls the light emission control driver 500 so that a width of the emission control signal may be adjusted in response to the light emission time value. In one embodiment, the light emission control driver 500 controls the width of the emission control signal so that the light emission time of pixels 60 are adjusted in response to control of the timing controller 420.

In example corresponding to Table 1, the lowest luminance value stored in the first lookup table is 2 nits. That is, a light emission time value is stored in the first lookup table when the luminance is 2 nits, and a light emission time value is not stored in this table when luminance is 1 nit. A light emission time value is not stored for 1 nit because, when luminance of 1 nit is implemented by adjusting the light emission time value, off-duty ratio reaches 99%. As a result, spot for each cell is increased and distribution of color deviation is increased. That is, it is not easy to implement the lowest luminance of 1 nit by adjusting the light emission time.

Accordingly, in one embodiment, luminance is controlled using the timing controller 420 and the first lookup table 600, in which the light emission time is stored up to the luminance of 2 nits, but luminance of 1 nit may be controlled by a different method.

As described above, the method of controlling luminance up to 2 nits may be referred to as a Dynamic AID method. (AID is an abbreviation of AMOLED Impulsive Driving). The Dynamic AID method may implement low luminance by changing a pulse width of an emission signal and increasing an AID off ratio. However, for a luminance of 1 nit, a different control method may be used. For example, a luminance of 1 nit may be implemented adopting both the Dynamic AID and an automatic current limit (ACL). Hereinafter, this will be particularly described.

When an image signal of one frame makes a whole screen emit light with high luminance, automatic current limiter 410 may reduce luminance of the whole screen by applying an algorithm of limiting a current (automatic current limit, hereinafter, referred to as the "ACL"). The ACL method may determine an average luminance value of an organic light emitting display panel by adding total data values to be displayed on the organic light emitting display panel, and then limiting driving current by adjusting an emission section according to the luminance value or by changing the image data itself.

Figure 8:
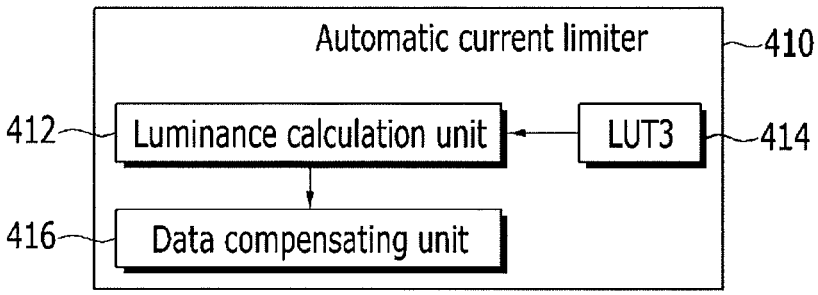
FIG. 8 illustrates an embodiment of an automatic current limiter.

FIG. 8 illustrates one example of automatic current limiter 410. Referring to FIG. 8, the automatic current limiter 410 includes a luminance calculation unit 412, a third lookup table 414, and a data compensating unit 416. The automatic current limiter 410 receives a luminance value from converter 430 and transmits the luminance value to the luminance calculation unit 412. The luminance calculation unit 412 adds up total luminance data for each frame, calculates an average value, and determines a compensation luminance value ΔY according to the calculated average value. The compensation luminance value is stored in the third lookup table 414. The data compensating unit 416 compensates for the data with the compensation luminance value and outputs the data as a compensated image data signal.

In the present embodiment, automatic current limiter 410 implements the lowest luminance of 1 nit using the automatic current limiter 410. That is, when it is desired to implement a luminance of 1 nit, the light emission time value corresponding to the luminance value of 2 nits is extracted from the first lookup table 600. Then, the current is limited so that the luminance value is decreased by a predetermined percentage (e.g., 50%) using the automatic current limiter 410. The current limit value is stored in the third lookup table 414. In this case, the limited current value is applied to ELVDD. That is, in a case where a voltage of the ELVDD side is decreased, a current output from the driving transistor is decreased. As a result, a current flowing in the OLED is decreased. A luminance decreased by 50% may therefore be implemented by decreasing the current. In other embodiments, luminance may be decreased by a different percentage.

In the present embodiment, in order to stably implement low luminance, a luminance of 2 nits or more is implemented by adjusting an off duty cycle width of the emission control signal, that is, light emission time. A luminance of 1 nit is implemented by applying the same light emission time as that of 2 nits and then limiting the current so that luminance is decreased by 50% using automatic current limiter 410. Accordingly, it is possible to prevent the AID off ratio from being excessively increased in the case where luminance of 1 nit is to be implemented. As a result, spot and color deviation may be avoided and a lowest luminance may be more stably implemented.

Figure 3:
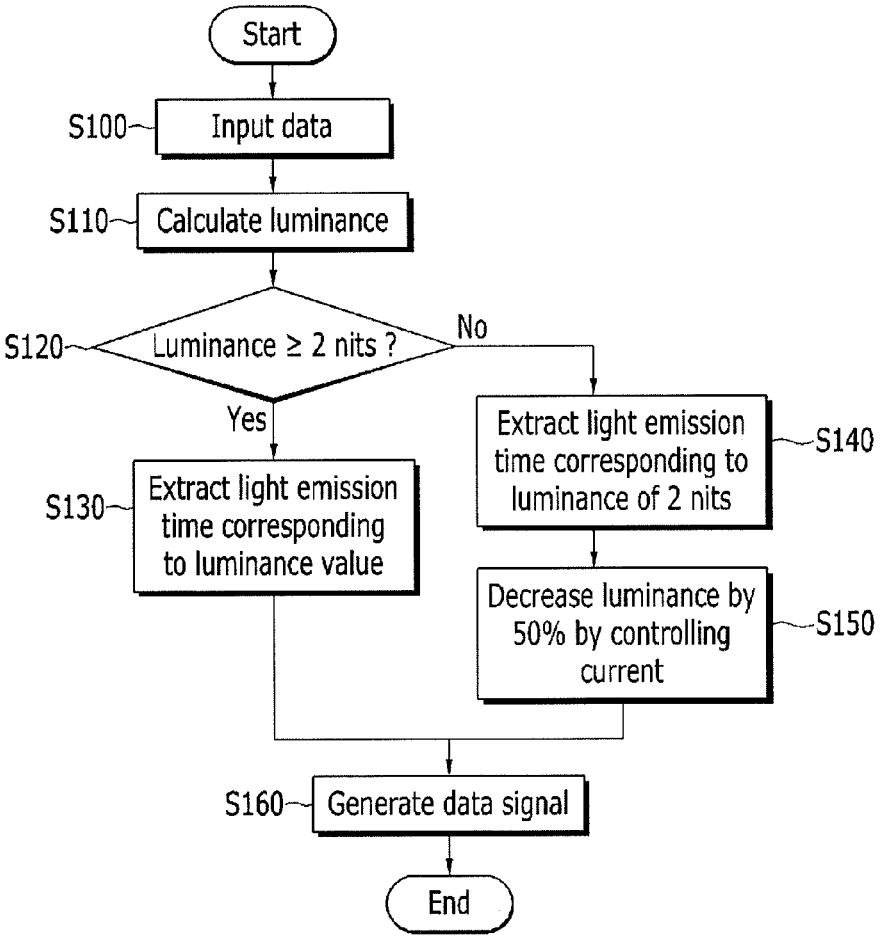
FIG. 3 illustrates an embodiment of a method for driving an organic light emitting display.

FIG. 3 illustrates an embodiment of a method for driving an organic electroluminescent display device. Referring to FIG. 3, initially, data Data is input to controller 400 from an external source (S100). The data input to the controller 400 is input to the converter, and a luminance value Y of at least one frame is extracted from the converter 430 (S110).

A determination is then made as to whether the extracted luminance value is equal to or larger than a predetermined number of nits (S120). The predetermined number of nits may be 2 nits or a different number of nits. When the extracted luminance value is equal to or larger than 2 nits, the extracted luminance value Y is supplied to the timing controller 420. The timing controller 420 receives the luminance value Y and extracts a light emission time value from the first lookup table 600 in response to the luminance value Y (S130).

The timing controller 420 controls the light emission control driver 500 so that the pixels 60 emit light for the light emission time. Then, the light emission control driver 500 generates an emission control signal having a width corresponding to the light emission time value. Further, the timing controller 420 realigns data supplied thereto and supplies the realigned data Data to the data driver 300. The data driver 300 receives the data Data and selects a gamma voltage corresponding to a gray scale value of the data Data and generates a data signal (S160).

When the luminance value extracted from converter 430 is less than 2 nits, the converter supplies the luminance value of the predetermined number of (e.g., 2) nits to the timing controller 420 and the automatic current limiter 410. The timing controller 420 receives the luminance value and extracts a light emission time value corresponding to the luminance value of 2 nits (S140). The timing controller 420 controls the light emission control driver 500 so that the pixels 60 emit light for the light emission time. Then, the light emission control driver 500 generates the emission control signal having a width corresponding to the light emission time value of 2 nits.

The automatic current limiter 410 receives the luminance value extracted from the converter 430 and compensates for data by limiting a current so that the calculated luminance value becomes a predetermined percentage (S150), e.g., 50%. The percentage may be a different value in other embodiments. The current limit value is stored in the third lookup table 414. The automatic current limiter 410 applies the limited current value to the EVLDD to adjust the quantity of the current.

The timing controller 420 realigns data provided thereto and supplies the realigned data Data to data driver 300. The data driver 300 receives the data Data and selects a gamma voltage corresponding to a gray scale value of the data Data and generates a data signal (S160).

Figure 2A:
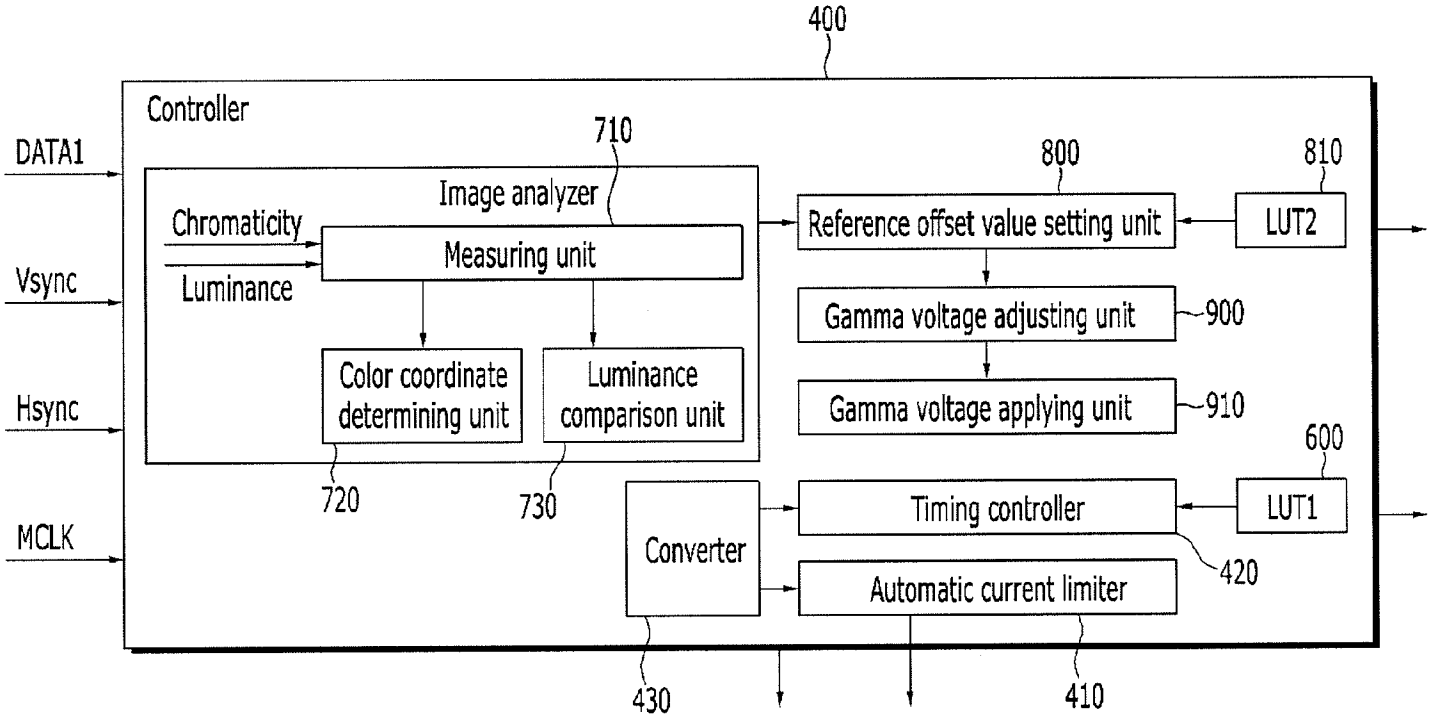
FIG. 2A illustrates an embodiment of a controller of the display.
Figure 2B:
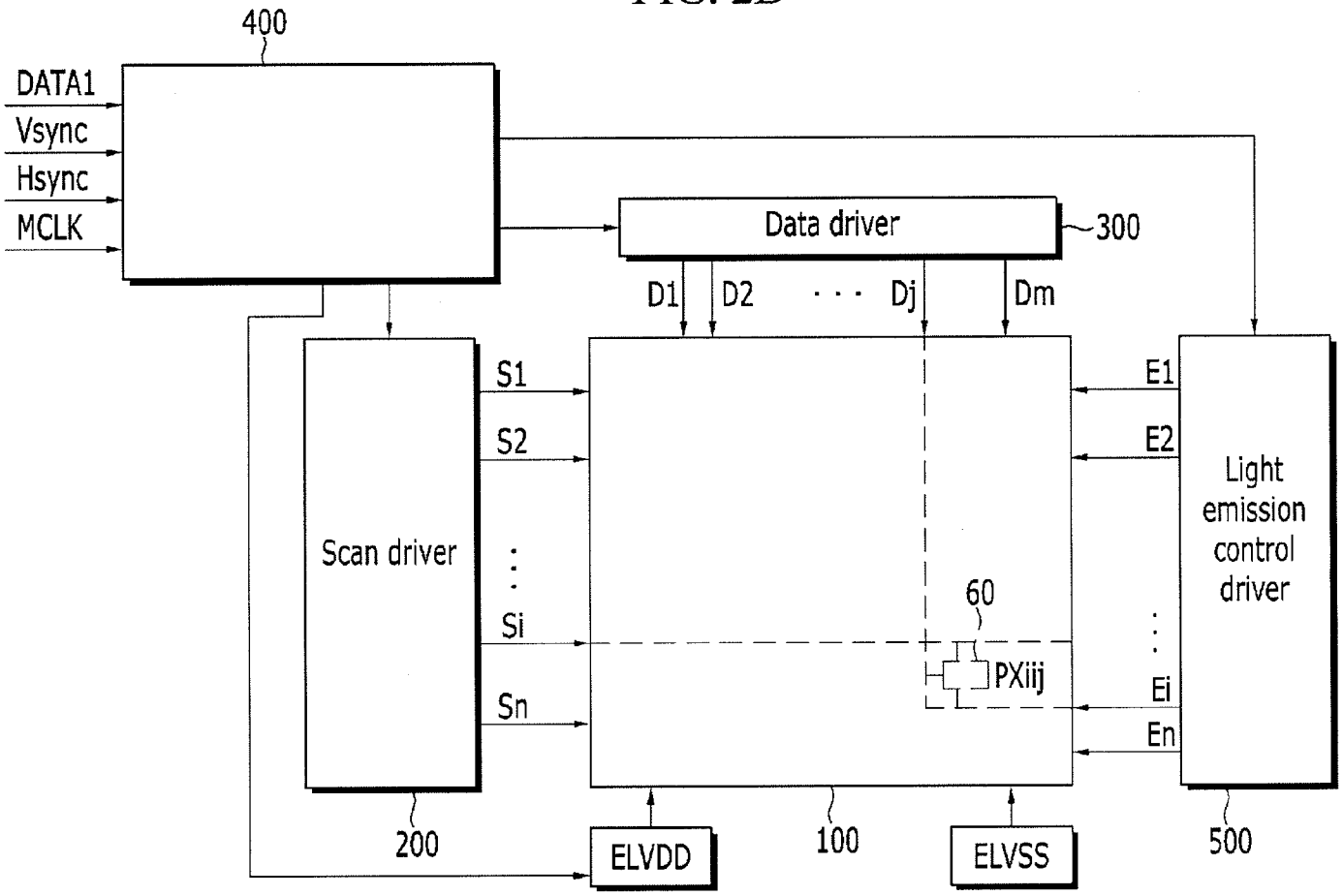
FIG. 2B illustrates another embodiment of an organic light emitting display.
Figure 4:
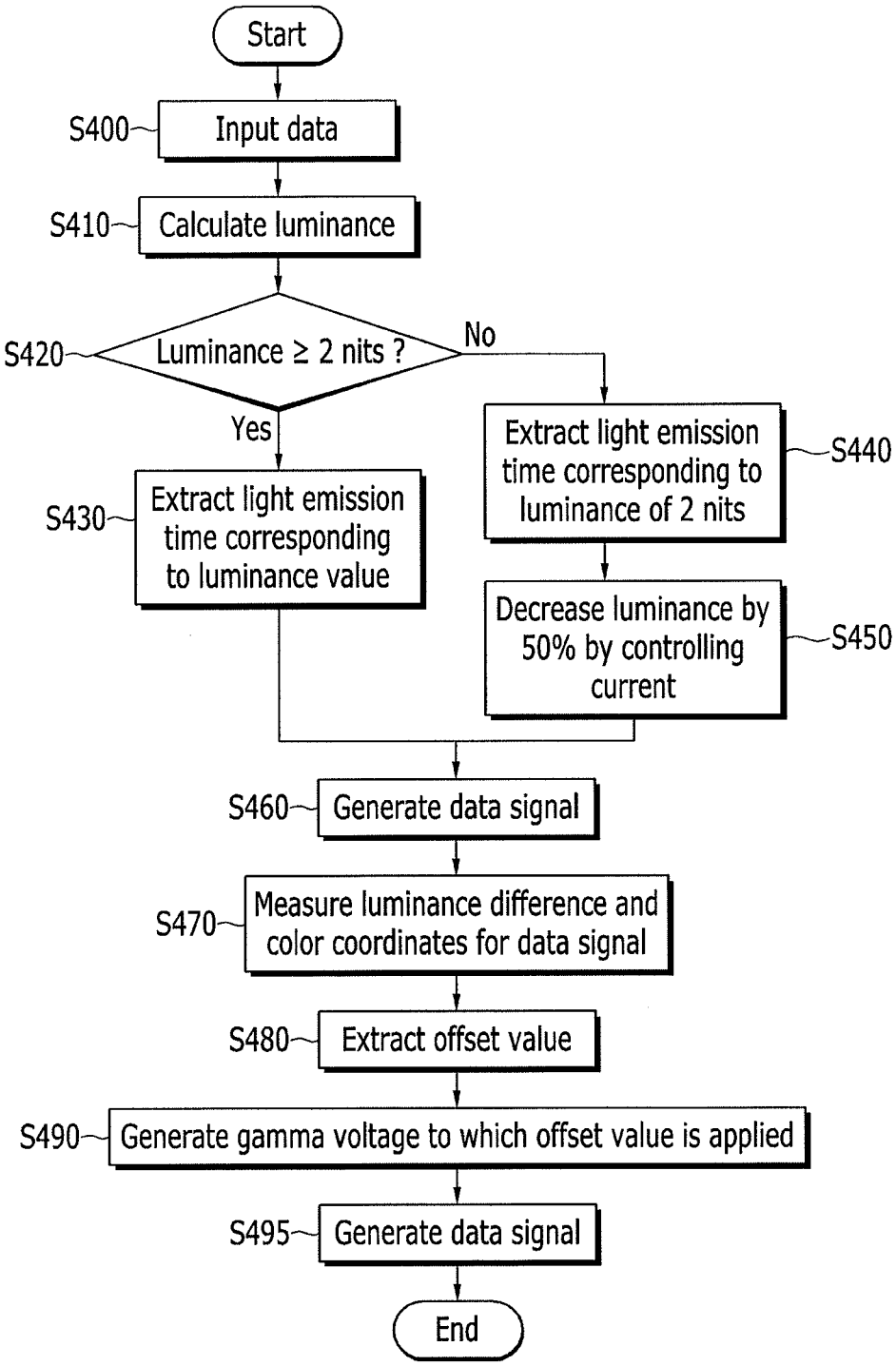
FIG. 4 illustrates another embodiment of a method for driving an organic light emitting display.

FIG. 2B illustrates another embodiment of an organic light emitting display according to another exemplary embodiment of the present invention, and FIG. 2A is an enlarged view of controller 400 in FIG. 2B. FIG. 4 illustrates another embodiment of a method for driving an organic light emitting display. This method may be similar to that described with reference to FIGS. 1 and 3, with the following exceptions.

Referring to FIG. 2B, the organic light emitting display device includes a display unit 100 having a plurality of pixels, a scan driver 200, a data driver 300, and a controller 400. The display unit 100 includes a plurality of signal lines S1 to Sn, D1 to Dm, and E1 to En, and a plurality of pixels 60 connected to the plurality of signal lines and approximately arranged in a matrix form.

The scan driver 200 generates a plurality of scan signals and transmits the generated scan signals to respective scan lines S1 to Sn according to a scan driving control signal from controller 400.

The data driver 300 receives a plurality of image data signals from controller 400, and generates and transmits a plurality of image data signals in the unit of one pixel row through respective data lines D1 to Dm.

The light emission control driver 500 generates a plurality of emission control signals, and transmits the emission control signals to respective emission control lines E1 to En according to the emission driving control signal from controller 400.

As illustrated in FIG. 2A, the controller 400 includes a converter 430, an automatic current limiter 410, a timing controller 420, a first lookup table 600, an emission control line driver 500, an image analyzer 700, a reference offset value setting unit 800, a second lookup table 810, a gamma voltage adjusting unit 900, and a gamma voltage applying unit 910.

The converter 430 generates a luminance value Y by using data Data. The converter 430 extracts the luminance value Y of at least one frame, and supplies the luminance value Y to the timing controller 420. The timing controller 400 extracts a light emission time value from the first lookup table 600 in response to the luminance value Y. The light emission time value is stored in the first lookup table 600.

The timing controller 420 extracts the light emission time value from the first lookup table 600 and controls the light emission control driver 500 so that a width of the emission control signal is adjusted in response to the light emission time value.

The organic light emitting display further includes a luminance correcting system in controller 400. The luminance correcting system includes image analyzer 700, reference offset value setting unit 800, gamma voltage adjusting unit 900, and gamma voltage applying unit 910. Image analyzer 700 is connected to data driver 300.

The image analyzer 700 analyzes an image displayed in a pixel unit and measures luminance and color coordinates for reference gray scale data. In one embodiment, the image analyzer 700 includes a measuring unit 710, a color coordinate determining unit 720, and a luminance comparing unit 730. The measuring unit 710 measures chromaticity and luminance of the image. The color coordinates determining unit 720 receives the measured chromaticity from the measuring unit 720 and determines color coordinates. The luminance comparing unit 730 receives the measured luminance from the measuring unit 710, and calculates a luminance difference between preset target luminance and the measured luminance.

The reference offset value setting unit 800 receives information indicative of the color coordinates and the luminance difference, and then sets a reference offset value for reference gray scale data in response to a result of an image analysis performed by the image analyzer 700.

In one embodiment, the reference offset value setting unit 800 sets a reference luminance offset value to adjust luminance in response to the luminance difference between the target luminance for the reference gray scale value and the measured luminance obtained by the luminance comparing unit 730. The color coordinate determining unit 720 may set a reference color coordinate offset value so that chromaticity is adjusted to correspond to the color coordinates for the obtained reference gray scale value.

For example, the reference offset value setting unit 800 may set a gamma adjusting value to compensate for a luminance difference between the target luminance and the measured luminance as the reference luminance offset value. The reference offset value setting unit 800 may also set a color coordinate movement value, to compensate for color coordinates distorted as a result of luminance correction, a process, and/or other effects, as the reference color coordinate offset value.

The reference offset value setting unit 800 may store the offset value corresponding to the luminance difference and/or the color coordinate in the second lookup table 810 connected to the reference offset value setting unit 800.

In one embodiment, larger offset values of red and blue are stored in the second lookup table instead of green. Larger offset values may be stored for these colors because green exhibits large sensitivity in a low gray scale region, and the offset of green may exert a larger influence on luminance, as well as for the color coordinates. Accordingly, the offset values of red and blue may be larger than the offset value of green stored in the second lookup table.

FIGS. 7A and 7B show examples of offset values that may be stored in the second lookup table. Referring to FIGS. 7A and 7B, the offset values of red and blue are larger than the offset values of green. That is, in the present embodiment, the color coordinates and the luminance are mainly corrected using red and blue.

The gamma voltage adjusting unit 900 adjusts the reference gamma voltage for the reference grayscale in response to the reference offset value set by the reference offset value setting unit 800. The adjusted reference gamma voltage are then supplied to the gamma voltage applying unit 910.

Further, the gamma voltage adjusting unit 900 may correct chromaticity by adjusting the color coordinates using the reference color coordinate offset value. In one embodiment, correction of the chromaticity may be simultaneously performed with luminance correction in response to the analysis result of the image. Alternatively, correction may be performed by analyzing the image corresponding to the luminance correction result, and then adjusting the color coordinates after the luminance correction is first performed. In this case, it is possible to correct the color coordinates distorted by luminance correction, to more effectively correct characteristic deviation of the panel.

The gamma voltage applying unit 910 applies the gamma voltage corrected through the gamma voltage adjusting unit 900 (that is, the reference gamma voltage corrected in accordance with the reference grayscale) to the data driver. The corrected reference gamma voltage may be implemented by adding the reference gamma voltage and the reference offset value in the manner previously described.

FIG. 4 illustrates another embodiment of a method for driving an organic electroluminescent display device. For illustrative purposes, this embodiment will be described with reference to FIGS. 2A and 2B. Initially, data Data is input to the controller 400 from an external system (S400). The data input to the controller 400 is input to the converter, and a luminance value Y of at least one frame is extracted from the converter 430 (S410).

A determination is then made as to whether the extracted luminance value is equal to or larger than a predetermined number of nits (S420). The predetermined number of nits may be 2 nits or a different number of nits. When the extracted luminance value is equal to or larger than a predetermined number of nits (e.g., 2 nits), the extracted luminance value Y is supplied to the timing controller 420. The timing controller 420 receives the luminance value Y and extracts a light emission time value from the first lookup table 600 in response to the luminance value Y (S430).

The timing controller 420 controls the light emission control driver 500 so that pixels 60 emit light for the light emission time. Then, the emission control driver 500 generates an emission control signal having a width corresponding to the light emission time value. The timing controller 420 realigns data provided thereto and supplies the realigned data Data to data driver 300. The data driver 300 receives the data Data and selects a gamma voltage corresponding to a gray scale value of the data Data and generates a data signal (S460).

When the luminance value extracted from the converter 430 is less than 2 nits, the converter supplies the luminance value of the predetermined number of (e.g., 2) nits to the timing controller 420 and automatic current limiter 410. The timing controller 420 receives the luminance value and extracts a light emission time value corresponding to the luminance value of 2 nits (S440).

The timing controller 420 controls the light emission control driver 500 so that pixels 60 emit light for the light emission time. Then, the emission control driver 500 generates the emission control signal having a width corresponding to the light emission time value.

The automatic current limiter 410 receives the luminance value extracted from the converter 430 and compensates for data by limiting a current, so that the calculated luminance value is reduced by a predetermined percentage (S450). The predetermined percentage may be 50% or another percentage. The limited current is applied to the ELVDD power source.

The timing controller 420 realigns data provided thereto and supplies the realigned data Data to data driver 300. The data driver 300 receiving the data Data selects a gamma voltage corresponding to a grayscale of the data Data and generates a data signal (S460).

The generated data signal is input to the image analyzer 700, and measuring unit 710 of the image analyzer measures a luminance difference and color coordinates for the data signal (S470). The luminance difference and color coordinates are input to the reference offset setting unit 800, and an offset value corresponding to the luminance difference and color coordinates is extracted from the second lookup table 810 (S480). The offset values of red and blue stored in second lookup table 810 may be larger than the offset value of green.

The extracted offset value is input to the gamma voltage adjusting unit 900, to generate the gamma voltage based on the offset value (S490). The gamma voltage is input from the gamma voltage applying unit 910 to the data driver (S495).

Figure 5:
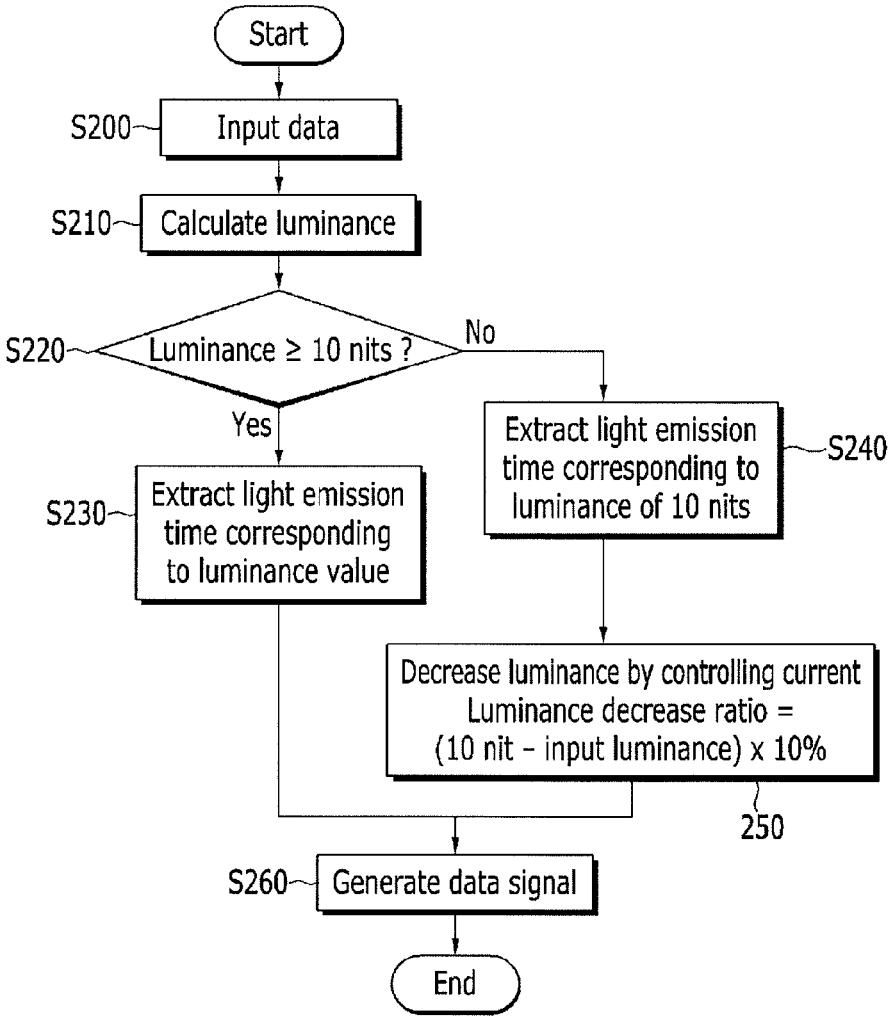
FIG. 5 illustrates another embodiment of a method for driving an organic light emitting display.
Figure 6:
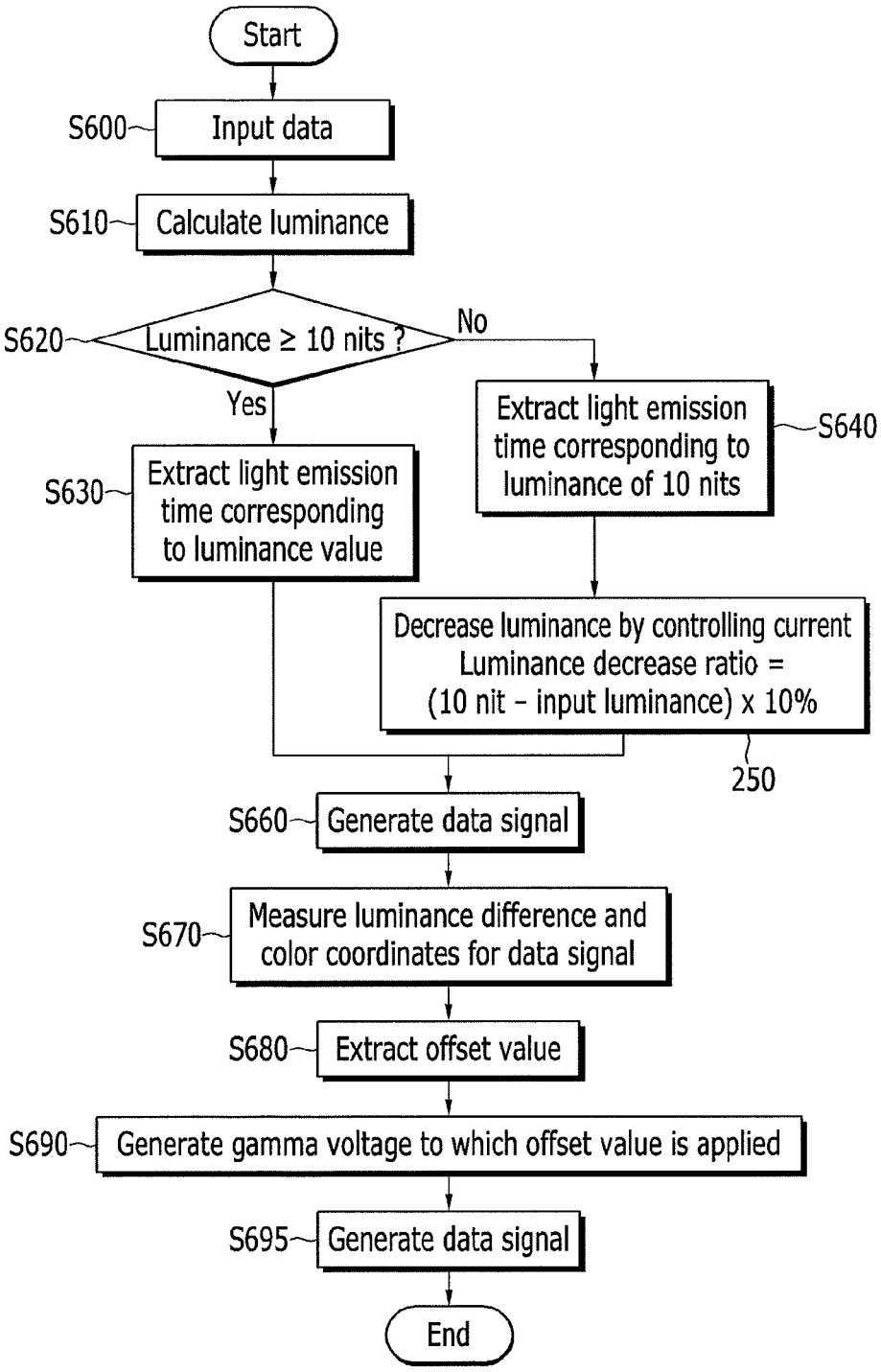
FIG. 6 illustrates another embodiment of a method for driving an organic light emitting display.

FIGS. 5 and 6 illustrate additional embodiments of a method for driving an organic electroluminescent display device. The methods in FIGS. 5 and 6 are similar to the method in FIGS. 3 and 4, with certain exceptions noted below.

The method of FIGS. 3 and 4 implements luminance up to 2 nits by dynamic AID and implements luminance of 1 nit by applying an automatic current limit (ACL) method to the dynamic AID. However, in the methods of FIGS. 5 and 6, luminance is implemented up to 10 nits by the dynamic AID, and luminance lower than 10 nits is implemented by differently applying the automatic current limit (ACL) to the dynamic AID for each luminance level.

Referring to FIG. 5, initially, data Data is input to controller 400 from an external system (S200). The data input to controller 400 is input to the converter, and a luminance value Y of at least one frame is extracted from the converter 430 (S210).

A determination is then made as to whether the luminance value is greater than or equal to 10 nits (S220). When the extracted luminance value is greater than 10 nits, the extracted luminance value Y is supplied to timing controller 420. The timing controller 420 receives the luminance value Y and extracts a light emission time value from the first lookup table 600 in response to the luminance value Y (S230).

The timing controller 420 controls the light emission control driver 500 so that pixels 60 emit light for the light emission time. Then, the light emission control driver 500 generates the emission control signal having a width corresponding to the light emission time value. Further, the timing controller 420 realigns data provided thereto and provides the data driver 300 with the realigned data Data. The data driver 300 receives the data Data and selects a gamma voltage corresponding to a gray scale value of the data Data and generates a data signal (S260).

When the luminance value extracted from the converter 430 is less than or equal to 10 nits, the converter supplies the luminance value of 10 nits to the timing controller 420 and automatic current limiter 410. The timing controller 420 receives the luminance value and extracts a light emission time value corresponding to 10 nits from the first lookup table 600 in response to each luminance value (S240).

The timing controller 420 controls the light emission control driver 500 so that pixels 60 emit light for the light emission time. Then, the light emission control driver 500 generates the emission control signal having a width corresponding to the light emission time value.

The automatic current limiter 410 receives the luminance value of 10 nits from the converter 430 and compensates for the data, so that the luminance value becomes a target luminance value by limiting a current (S250). In this case, the automatic current limiter controls the current so that the luminance of 10 nits reaches the target luminance, that is, the luminance value first extracted by the converter. The limited current is applied to the ELVDD power source.

A degree of the automatic current limit (ACL) may be adjusted to a degree corresponding to each luminance level, for example, by setting a degree of the automatic current limit (ACL) at 10 nits to be a predetermined percentage (e.g., 0%) and a degree of the automatic current limit (ACL), so that the luminance of 10 nits is recognized as the luminance of 1 nit to be, for example, 90%.

That is, when the luminance value extracted by the converter is 9 nits, the luminance of 10 nits is input to the automatic current limiter 410 and timing controller 420. The timing controller generates the emission control driving signal corresponding to the luminance of 10 nits. The automatic current limiter 410 controls the degree of the automatic current limit (ACL) to 10%, so that the luminance of 10 nits is recognized as the luminance of 9 nits, thereby implementing the luminance of 9 nits.

Referring to FIG. 6, initially, data Data is input to controller 400 from an external source (S600). The data input to the controller 400 is input to the converter, and a luminance value Y of at least one frame is extracted from the converter 430 (S610).

A determination is made as to whether the luminance value is greater than or equal to 10 nits (S620). When the extracted luminance value is larger than 10 nits, the extracted luminance value Y is supplied to timing controller 420. The timing controller 420 extracts a light emission time value from the first lookup table 600 in response to the luminance value Y (S630).

The timing controller 420 controls the light emission control driver 500 so that pixels 60 emit light for the light emission time. Then, the light emission control driver 500 generates the emission control signal having a width corresponding to the light emission time value. Further, the timing controller 420 realigns data provided thereto and supplies the realigned data Data to the data driver 300. The data driver 300 receives the data Data and selects a gamma voltage corresponding to a grayscale of the data Data and generates a data signal (S660).

When the luminance value extracted from the converter 430 is equal to or less than 10 nits, the converter supplies the luminance value of 10 nits to the timing controller 420 and automatic current limiter 410. The timing controller 420 extracts a light emission time value corresponding to 10 nits from the first lookup table 600 in response to each luminance value (S640).

The timing controller 420 controls the light emission control driver 500, so that pixels 60 emit light for the light emission time. Then, the light emission control driver 500 generates the emission control signal having a width corresponding to the light emission time value.

The automatic current limiter 410 receives the luminance value of 10 nits from the converter 430 and compensates for the data, so that the luminance value becomes a target luminance value by limiting a current (S650). The automatic current limiter controls the current so that the luminance of 10 nits reaches the target luminance, that is, the luminance first extracted by the converter. In this case, a decrease ratio of the luminance by the current limit is (10 nits−input luminance)*10%. That is, when the input luminance is 7 nits, the light emission control driver generates the emission control signal corresponding to 10 nits. The luminance is then decreased by 30% (10 nits−7 nits)*10%=30%) by the automatic current limiter to implement 7 nits.

That is, a degree of the automatic current limit (ACL) may be adjusted to a degree corresponding to each luminance level, by setting a degree of the automatic current limit (ACL) at 10 nits to be a predetermined percentage (e.g., 0%) and a degree of the automatic current limit (ACL) (=luminance decrease ratio) so that the luminance of 10 nits is recognized as the luminance of 1 nit to be, for example, 90%. The limited current value is applied to the ELVDD power source.

The timing controller 420 realigns data provided thereto and supplies the realigned data Data to data driver 300. The data driver 300 receives the data Data and selects a gamma voltage corresponding to a gray scale value of the data Data and generates a data signal (S660).

The generated data signal is input to the image analyzer 700, and the measuring unit 710 of the image analyzer measures luminance difference and color coordinates for the data signal (S670). The luminance difference and color coordinates are input to the reference offset value setting unit 800. The offset value corresponding to the luminance difference and color coordinates is then extracted from the second lookup table 810 (S680). The offset values of red and blue may be larger than the offset value of green.

The extracted offset value is input to the gamma voltage adjusting unit, so that the offset value is applied (S690). The gamma voltage is input from the gamma voltage applying unit to the data driver (S695).

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A method of driving an organic electroluminescent display device, the method comprising:

determining a luminance value from input data;

adjusting the luminance value by a first method when the luminance value is greater than or equal to a predetermined number of nits;

adjusting the luminance value by a second method when the luminance value is less than the predetermined number of nits; and generating data to which the first or second method is applied, wherein:

the first method adjusts the luminance value by adjusting light emission time, the second method adjusts the luminance value based on a light emission time that corresponds to the predetermined number of nits and then decreases the luminance value by a percentage by limiting a current, and the predetermined number of nits is between 2 nits and 10 nits inclusive.

2. The method as claimed in claim 1, wherein the first method includes:

supplying the luminance value to a timing controller;

extracting a light emission time value corresponding to the luminance value from a first lookup table; and controlling a light emission control driver in response to the extracted light emission time value.

3. The method as claimed in claim 2, wherein the first lookup table includes light emission times that decrease from a first luminance value to a second luminance value less than the first luminance value.

4. The method as claimed in claim 1, wherein the second method includes:

supplying luminance of the predetermined number of nits to a timing controller;

extracting a light emission time value corresponding to the predetermined number of nits from a first lookup table;

controlling a light emission control driver in response to the extracted light emission time value; and decreasing the luminance by the percentage by limiting a current.

5. The method as claimed in claim 4, wherein:

the first lookup table includes light emission times that decrease with decreasing luminance, and a smallest luminance in the first lookup table corresponds to the predetermined number of nits.

6. The method as claimed in claim 4, wherein decreasing the luminance by the percentage includes:

determining a luminance compensation value from the luminance determined from the input data;

extracting a degree of automatic current limit corresponding to the compensation value from a third lookup table; and limiting the current in response to the extracted degree of the automatic current limit.

7. The method as claimed in claim 1, further comprising:

measuring a luminance difference and color coordinates for the generated data;

extracting an offset value for the luminance difference and color coordinates; and applying the extracted offset value.

8. The method as claimed in claim 7, wherein:

the offset value is extracted from a second lookup table, and the second lookup table includes offset values of red and blue larger than an offset value of green.

9. The method as claimed in claim 7, wherein applying of the extracted offset value includes:

adjusting a gamma voltage in response to the offset value, and supplying the adjusted gamma voltage to the gamma voltage applying unit.

10. A method of driving an organic electroluminescent display device, the method comprising:

generating a luminance value from input data;

adjusting the luminance value based on a first method when the luminance value is greater than or equal to 10 nits; and adjusting the luminance value based on a second method when the luminance value is less than 10 nits, wherein the first method adjusts a light emission time according to the luminance value and the second method adjusts the luminance value based on a light emission time corresponding to the luminance value of 10 nits and then decreases the luminance by a percentage by limiting a current.

11. The method as claimed in claim 10, wherein the first method includes:

supplying the luminance value to a timing controller;

extracting a light emission time value corresponding to the luminance value from a first lookup table; and controlling a light emission control driver in response to the extracted light emission time value.

12. The method as claimed in claim 11, wherein the first lookup table includes light emission times that decrease from a first luminance value to a second luminance value less than the first luminance value.

13. The method as claimed in claim 10, wherein the second method includes:

supplying the luminance value of 10 nits to a timing controller;

extracting a light emission time value corresponding to 10 nits from a first lookup table;

controlling a light emission control driver in response to the extracted light emission time value; and decreasing the luminance value by limiting the current.

14. The method as claimed in claim 13, wherein decreasing of the luminance value includes decreasing ratio of the luminance value based on the following equation: (the luminance value of 10 nits−first generated luminance value) *10%.

15. The method as claimed in claim 14, wherein decreasing the luminance value includes:

determining a luminance compensation value from the luminance generated from the input data;

extracting a degree of automatic current limit corresponding to the compensation value from a third lookup table; and limiting the current in response to the extracted degree of the automatic current limit.

16. The method as claimed in claim 10, further comprising:

measuring a luminance difference and color coordinates for the generated data;

extracting an offset value for the luminance difference and the color coordinates; and applying the extracted offset value.

17. The method as claimed in claim 16, wherein:

the offset value is extracted from a second lookup table, and the second lookup table includes offset values of red and blue larger than an offset value of green.

18. The method as claimed in claim 17, wherein applying of the extracted offset value includes:

adjusting a gamma voltage in response to the offset value, and supplying the adjusted gamma voltage to the gamma voltage applying unit.

* * * * *